US008904709B2

(12) United States Patent
Ajiki et al.

(10) Patent No.: US 8,904,709 B2
(45) Date of Patent: Dec. 9, 2014

(54) MOVABLE HOLDER

(75) Inventors: Shinichi Ajiki, Tokyo (JP); Kazuyoshi Oshima, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 632 days.

(21) Appl. No.: 12/680,768

(22) PCT Filed: Oct. 2, 2008

(86) PCT No.: PCT/JP2008/067937
§ 371 (c)(1),
(2), (4) Date: Mar. 30, 2010

(87) PCT Pub. No.: WO2009/044813
PCT Pub. Date: Apr. 9, 2009

(65) Prior Publication Data

US 2011/0131885 A1 Jun. 9, 2011

(30) Foreign Application Priority Data

Oct. 3, 2007 (JP) ..... 2007-259438

(51) Int. Cl.
*E05D 15/28* (2006.01)

(52) U.S. Cl.
USPC ..... 49/246; 49/208; 49/219; 312/325; 312/319.2

(58) Field of Classification Search
None
See application file for complete search history.

(56) References Cited

U.S. PATENT DOCUMENTS

| | | | | | |
|---|---|---|---|---|---|
| 2,062,467 | A * | 12/1936 | McCaughan | 312/237 |
| 4,294,039 | A * | 10/1981 | Dalheimer et al. | 49/248 |
| 4,429,933 | A * | 2/1984 | Sokolowski | 16/333 |
| 5,581,941 | A * | 12/1996 | Sill et al. | 49/246 |
| 5,971,514 | A * | 10/1999 | Hayakawa | 312/319.2 |
| 6,296,337 | B1 * | 10/2001 | Kawanabe | 312/319.2 |
| 6,442,799 | B1 * | 9/2002 | Duarte et al. | 16/277 |
| 7,047,600 | B2 * | 5/2006 | Muir | 16/366 |
| 7,143,548 | B2 * | 12/2006 | Kleinmann et al. | 49/345 |
| 7,178,202 | B2 * | 2/2007 | Hirtsiefer et al. | 16/366 |
| 7,240,974 | B2 * | 7/2007 | Hirtsiefer | 312/109 |
| 7,610,656 | B2 * | 11/2009 | Vanini | 16/286 |
| 7,976,079 | B2 | 7/2011 | Hirtsiefer | |
| 2001/0039762 | A1 * | 11/2001 | Giovannetti | 49/246 |
| 2006/0053589 | A1 * | 3/2006 | Vanini | 16/286 |
| 2009/0072551 | A1 | 3/2009 | Hirtsiefer | |

FOREIGN PATENT DOCUMENTS

| | | | |
|---|---|---|---|
| JP | 2003-278440 | A | 10/2003 |
| JP | 2004-316223 | A | 11/2004 |
| JP | 2005-240465 | A | 9/2005 |
| JP | 2005-264719 | A | 9/2005 |
| WO | 2006111236 | A1 | 10/2006 |

OTHER PUBLICATIONS

International Search Report dated Dec. 5, 2008 of PCT/JP2008/067937, filed Oct. 2, 2008.

* cited by examiner

*Primary Examiner* — Gregory J. Strimbu
(74) *Attorney, Agent, or Firm* — Pearne & Gordon LLP

(57) ABSTRACT

A moveable holder for connecting a moveable member to a stationary member includes two pivoting arms mountable between the members. The moveable member has a position abutting the stationary member and a position spaced away from the stationary member. One of the arms is spring-loaded such that the moveable member is easily urged to either the abutting position or the spaced-away position when the moveable member is located at a neutral position intermediate to the abutting position and the spaced-away position.

2 Claims, 6 Drawing Sheets

MOVABLE HOLDER

TECHNICAL FIELD

This invention relates to a movable holder such as a door opening/closing holder to move forward and back a movable member such as a door relative to a stationary member such as an opened case to thereby move the movable member close to or far away from the stationary member, and more particularly this invention relates to a movable holder to automatically urge a movable member to a position shifted from a neutral position between a position where the movable member is close to and far away from a stationary member and a position where the movable member is far away from the stationary member when the movable member is even slightly shifted from the neutral position.

BACKGROUND OF THE INVENTION

The movable holder of this kind is so designed to be urged that when the door is to be held at a position where an opening of the case is closed by the door moving close to the opening of the case or at a position where the opening of the case is opened by the door moving far away from the case, the door is automatically opened by an operation to manually open the door midway of a door opening direction (one neutral-shifted position where the door is slightly shifted from the neutral position in the door opening direction) and automatically closed by an operation to manually close the door midway of a door closing direction (another neutral-shifted position where the door is slightly shifted from the neutral position in the door closing direction).

This movable holder generally includes a link arm having both ends pivotally supported on the door and the case between them. The link arm is adapted to movably move forward and backward between a first position (a closed position) where the door gets closer to the case and a second position (an opened position) where the door gets far away from the case. The link arm is provided with resilient urging means comprising a spring or a combination of a spring and a swinging arm to automatically pivotally move the link arm to either of the first position and the second position when the link arm is even slightly shifted to the first position or the second position from a middle position between the first position and the second position.

In one conventional movable holder, the resilient urging means comprises a swinging arm having one end pivotally supported on a free end of the link arm and an expansion/contraction spring connected the other end of the swinging arm so that when the link arm is even slightly shifted in either of directions from the neutral position where the pivotal support portions of the link arm and the swinging arm get straight, the expansion/contraction spring pivotally moves the swinging arm to the shifted dside to thereby automatically urge the movable holder to the opened position or the closed position (see Patent Document 1).

Since the movable holder of such a construction has the expansion/contraction spring disposed so as to pivotally move the free end of the link arm, the expansion/contraction spring could not but be exposed from the link arm and therefore, the expansion/contraction spring is exposed when the door is opened, which disadvantageously causes the appearance of the movable holder to be worsened.

In another conventional movable holder, there are two link arms on the sides of the case and the door and the resilient urging means comprises an expansion/contraction spring provided between the case side link arm and the door so that when the link arm is even slightly shifted in either direction from a neutral position where the movable ends of the two link arms and the expansion/contraction spring arm get straight, the expansion/contraction spring urges the link arms to automatically pivotally move to the opened position or the closed position (see Patent Document 2).

The movable holder of such a construction has the expansion/contraction spring hidden on the back side of the door when the door is opened, but the expansion/contraction spring can appear from the side of the door, which similarly causes the appearance of the movable holder to be worsened. Furthermore, since the link arms and the expansion/contraction spring are in the intersection state, a finger or fingers are accidentally placed between the intersection portions.

Further conventional movable holder comprises two link arms provided between the door and the case and the resilient urging means of the movable holder comprises an expansion/contraction spring provided the case side end of one of the link arms and expanded/contracted in accordance with a movement of a movable pin which is slidably engaged into an arc-like groove in a mount portion on the side of the case. When one of the link arms is even slightly shifted in either direction from the middle position (neutral position) of the arc-like groove, the expansion/contraction spring swings the link arm along the arc-like groove to either of the ends whereby the door is automatically urged to the opened position or the closed position (see patent document 3).

Since the movable holder of such a construction has the expansion/contraction spring assembled into the link arms, the appearance is never worsened, but if the mount portion having the arc-like groove is even slightly displaced from a proper mount position (including a vertical position, a horizontal position and an angular position) relative to the case, the closing state of the door and the case is never held properly at the closed position thereof, it will be troublesome to set the mount position and since the mount portion having the arc-like groove contains the expansion/contraction spring, the mount portion disadvantageously gets large-sized and worsens the appearance.

Patent document 1: U.S. Pat. No. 2,717,106 specification
Patent document 2: JP2005-264719A
Patent document 3: JP2-176086A

DESCRIPTION OF THE INVENTION

It is an object of the invention to provide a movable holder adapted to prevent an appearance from being lowered and a finger or fingers from being placed into the movable holder, to be more easily attached and to make simpler a construction of holding portion of an expansion/contraction spring without being large-sized.

The movable holder of the present invention includes first and second mount members to be attached to a movable member and a stationary member, respectively and two link arms having both ends pivotally supported on said first and second mount members between them, said movable holder being held so as to movably move forward and backward between a first position where said movable member is close to said stationary member and a second position where said movable member is far away from said stationary member and being further provided with resilient urging means including an expansion/contraction spring to urge said two parallel link arms to be automatically pivotally moved to either of said first and second position when said two link arms are even slightly shifted from a mid-position between said first and second positions, said movable holder characterized in that said resilient urging means further includes a swinging arm having one end pivoted adjacent to a pivoted portion of one end of one of said link arms at said first mount member and other end sliding along a linear guide provided in said one link arm and said expansion/contraction spring is disposed between said one link arm and said swinging arm so as to urge said swinging arm along said linear guide to said first or second position of said link arms.

In the movable holder of the invention, the expansion/contraction spring may be preferably disposed within said one link arm. The linear guide may be in the form where it comprise an elongated groove provided in the one link arm and the other end of the swinging arm may have a pivotal pin slidably engaged into the elongated groove. In this case, the movable end of the expansion/contraction spring may be preferably connected with the pivotal pin.

In accordance with the invention, since the expansion/contraction spring is arranged between one of the link arms and the swinging arm so that the other end of the swinging arm is urged along the linear guide provided in the one link arm, the expansion/contraction spring never protrudes so much from the one link arm and therefore the appearance is never prevented from being lowered and the finger or fingers are prevented from being placed in the movable holder. Furthermore, since the swinging arm following the expansion/contraction spring moves along the straight linear guide, the movement of the swinging arm can be made more smoothly in comparison with the movement of the swinging arm along the arc-like groove. In addition thereto, the structure of the guide portion is simplified and small-sized and the attachment of the movable holder can be more easily made because there are not required such parts as are to be attached while taking care of the mount position.

BRIEF DESCRIPTION OF THE DRAWINGS

FIG. 2A is a cross sectional view of the cabinet having the door closed position, FIG. 2B is a cross sectional view of the cabinet having the door half-opened position and FIG. 2C is a cross sectional view of the cabinet having the door opened position;

FIG. 4A is a cross sectional view of the cabinet along the line A-A of FIG. 1 and FIG. 4B is a cross-sectional view along the line 4B-4B of FIG. 4A of the link arm having the resilient urging means;

FIGS. 5A and 5B illustrate the state of the movable holder when the door is half-opened wherein FIG. 5A is a cross-sectional view along the line A-A of FIG. 1 of the cabinet and FIG. 5B is a cross-sectional view along the line 5B-5B of FIG. 5A of the link arm having the resilient urging means; and FIGS. 6A and 6B illustrate the state of the movable holder when the door is opened wherein FIG. 6A is a cross-sectional view along the line A-A of FIG. 1 of the cabinet and FIG. 6B is a cross-sectional view along the line 6B-6B of FIG. 6A of the link arm having the resilient urging means.

BEST MODE OF EMBODIMENT OF THE INVENTION

Figure 1:
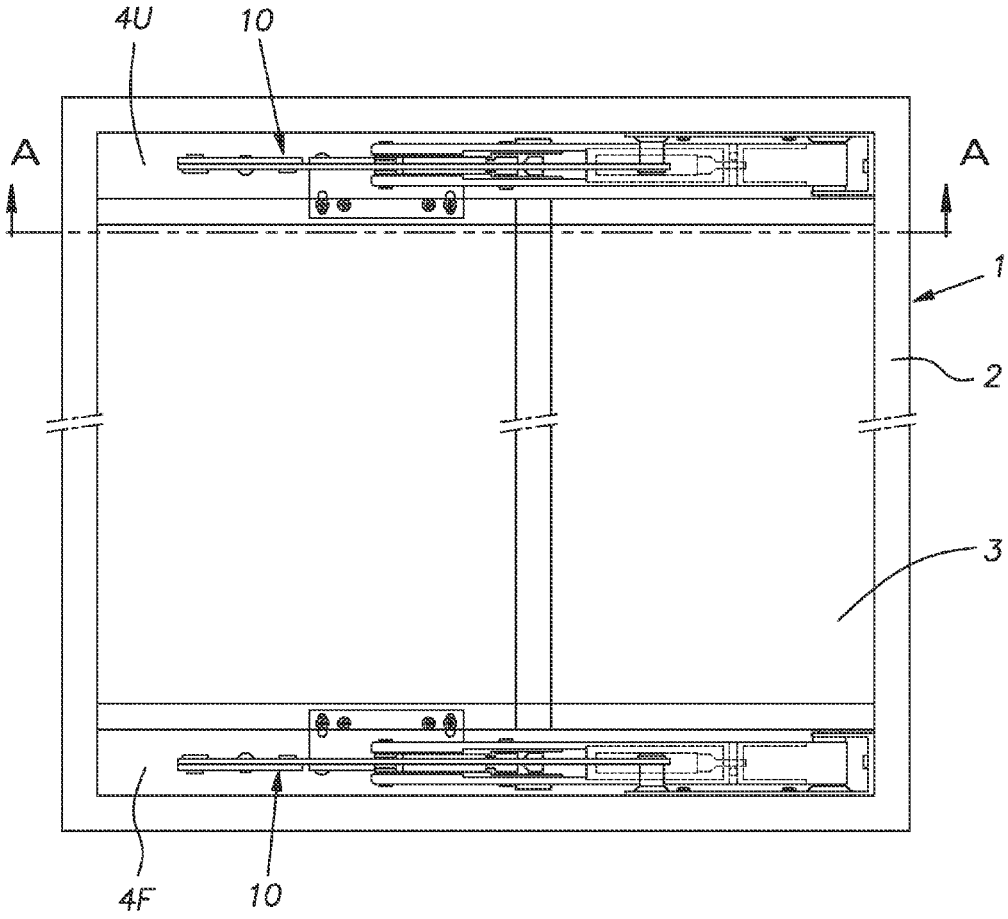
FIG. 1 is a schematic diagram of a cabinet using a movable holder of the invention.

There is illustrated in FIGS. 1 and 2 a cabinet 1 using a movable holder 10 constructed in accordance with the mode of preferred embodiment of the invention. The cabinet 1 comprises a case (stationary member) 2 and a door (movable member) 3. The movable holder 10 is disposed within a space of a top board 4U and within a space of a floor board 4F and holds the door 3 on the case 2 so that the door 3 is opened or closed relative to the case 2.

Figure 2A:
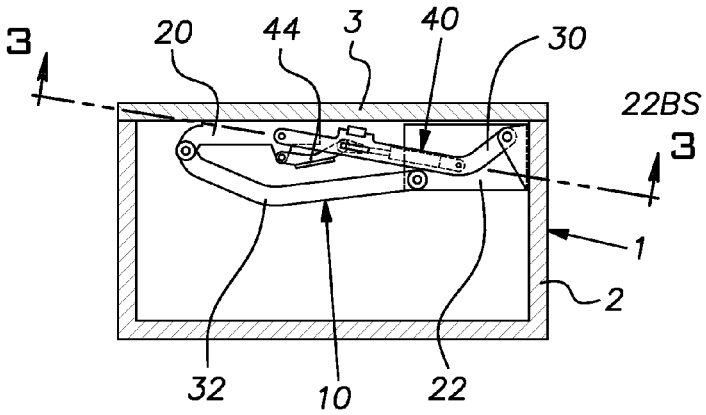
FIGS. 2A, 2B and 2C illustrate transition of an operation of the cabinet using the movable holder according to one form of embodiment of the invention with a case thereof shown in cross section along the line A-A of FIG. 1.
Figure 2B:
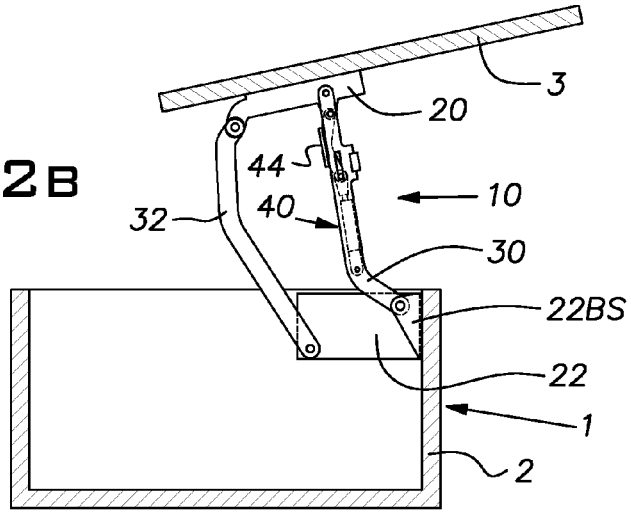
Figure 2C:
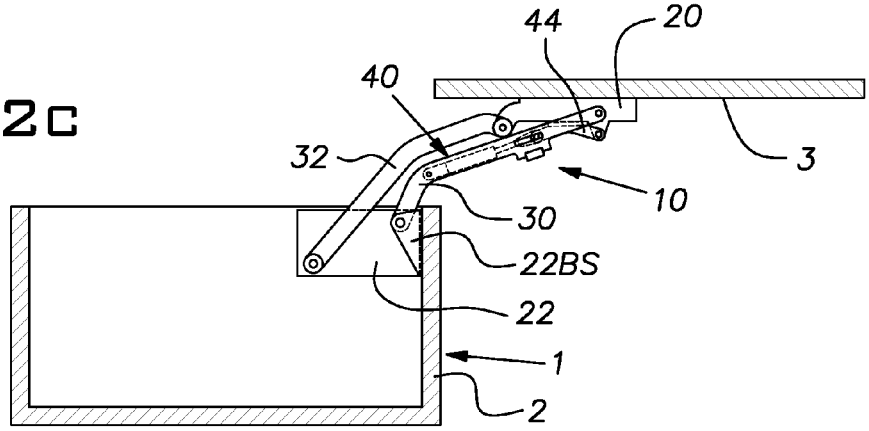

As shown in FIG. 2, the movable holder of the invention comprises first and second mount members 20 and 22 to be attached to the door (movable member) 3 and the case (stationary member) 2, respectively and two parallel link arms 30 and 32 having both ends pivotally supported on the first and second mount members 20 and 22 between them whereby the door 3 is movably held on the case 2 so as to movably move forward and backward the door 3 between a first position where the door (movable member) 3 is close to the case (stationary member) 2 (the door closed position of FIG. 2(A) in the illustrated form) and a second position where the door (movable member) 3 is far away from the case (stationary member) 2 (the door opened position of FIG. 2(C) in the illustrated form).

Figure 5A:
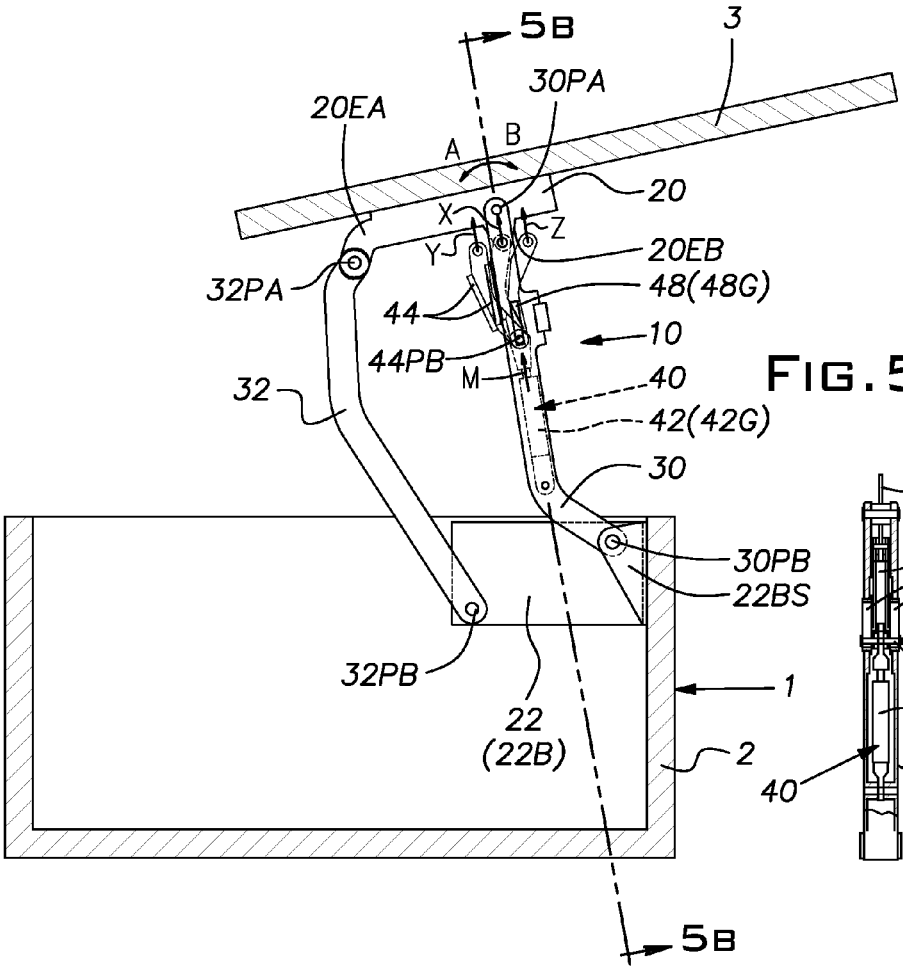
Figure 5B:
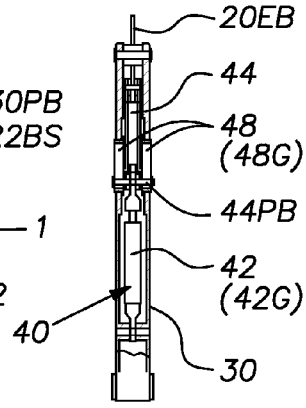

Furthermore, the movable holder 10 is further provided with resilient urging means 40 including an expansion/contraction spring 42 to urge the parallel two link arms 30 and 32 to be automatically pivotally moved to either of the first and second positions when the two link arms 30 and 32 are even slightly shifted from the middle position (see FIG. 2(B) and FIG. 5) between the first and second positions to the first or second position.

As shown in FIGS. 2, 3 and 4 through 6, the first mount member 20 may be formed of a strip 20B attached to the back face of the door 3 by screws or any other appropriate means. One end 30EA of one link arm 30 of the link arms 30 and 32 is pivotally supported by a pivotal pin 30PA to the strip 20B and one end 32EA of the other link arm 32 is pivotally supported by a pivotal pin 32PA on a curved extension 20EA of the strip 20B.

Similarly, as shown in FIGS. 2, 3 and 4 through 6, the second mount member 22 may be formed of a rectangular plate 22B attached to the inner face of the case 2 by screws or any other appropriate means. The other end 30EB of the one link arm 30 is pivotally supported by a pivotal pin 30PB on the rectangular plate 22B and the other end 32EB of the other link arm 32 is pivotally supported by a pivotal pin 32PB on the rectangular plate 22B. As described later, since a part of the resilient urging means 40 is contained in the link arm 30, the link arm 30 is not in a flat plate form, but in a square-cylindrical form and therefore, the rectangular plate 22 has an auxiliary support 22BS integral to the rectangular plate 22B for supporting the end 30EB of the link arm 30 so as to be held around the auxiliary support 22BS in order to reinforce the support by the pivotal pin 30PB.

The resilient urging means 40 includes a swinging arm 44 having both ends pivotally supported on the link arm 30 and the strip 20B, which is the first mount member 20, adjacent to the pivotal support portion of one end of the link arm 30 in the illustrated form of embodiment. The expansion/contraction spring 42 is disposed between the one link arm 30 and the swinging arm 44 so as to resiliently move the swinging arm 44 in accordance with the movement of the parallel link arms 30 and 32. The spring 42 has a longitudinal axis which intersects an axis of the pivoted pin 30PA.

Figure 3:
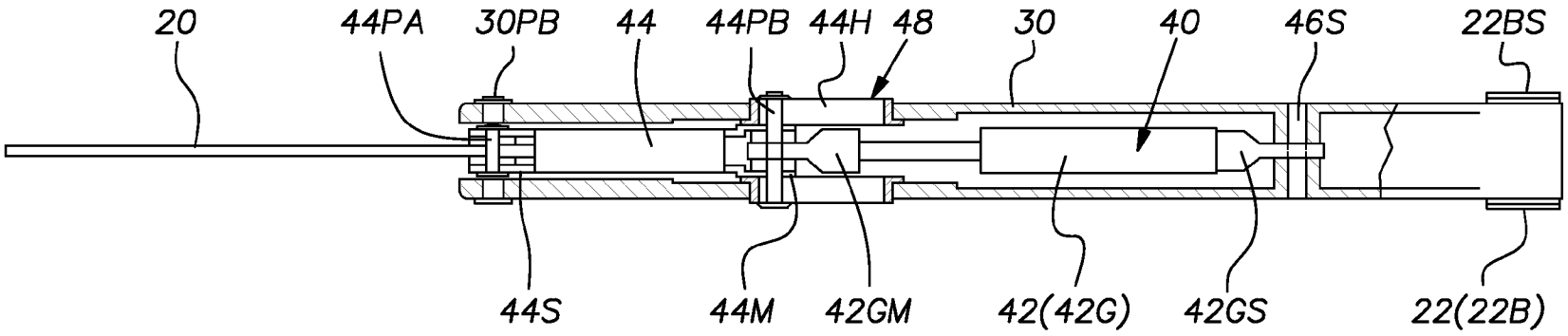
FIG. 3 is an enlarged cross-sectional back view along the line 3-3 of FIG. 2A of one of the arm links relevant to resilient urging means used for the movable holder with only the arm body shown in cross section and seen from the back side of the door.

As particularly illustrated in FIG. 3 in details, the fixed end 44S of the swinging arm 44 is pivotally supported on a second extension 20EB of the strip 20B by a pivotal pin 44PA while the movable end 44M of the swinging arm 44 is pivotally supported on the link arm 30 by a pivotal pin 44PB slidably movable along a linear guide 48 provided in the link arm 30.

In the illustrated form, the expansion/contraction spring 42 may comprise a cylinder-like gas spring 42G. The fixed end 42GS of the gas spring is fixed to the link arm 30 by a fixing pin 46S while the movable end 42GM thereof is connected with the pivotal pin 44PB which in turn pivotally supports the movable end 44M of the swinging arm 44 on the link arm 30.

In the illustrated form, the linear guide 48 may comprise an elongated groove 48G provided in the link arm 30. In the elongated groove 48G is slidably engaged the pivotal pin 44PB, which pivotally supports the movable end 44M of the swinging arm 44 on the link arm 30 and connects the movable end 42GM of the gas spring 42G to the link arm 30.

Figure 4A:
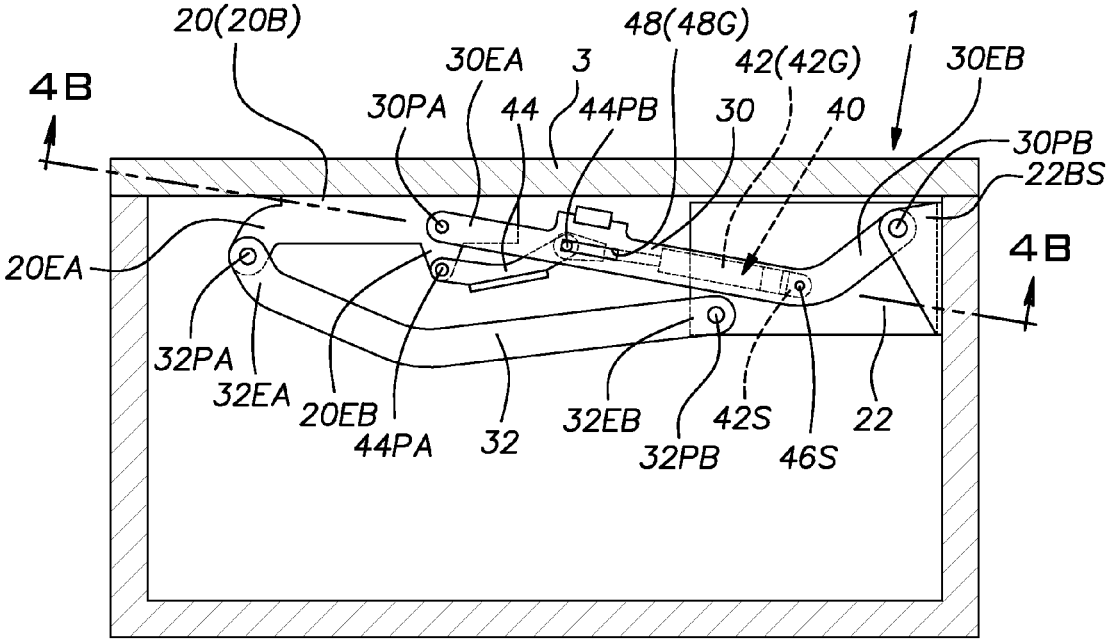
FIGS. 4A and 4B illustrate the state of the movable holder when the door is in the closed position.
Figure 4B:
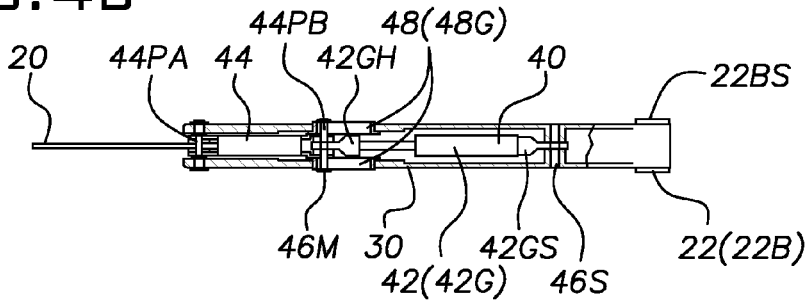

An operation of the movable holder 10 in the aforementioned form of embodiment will be explained with reference to FIGS. 4 through 6. First, in the state where the door 3 closes the opening of the case 2, the parallel link arms 30 and 32 are contained in the folded state within the space of the top board 4U and the floor board 4F of the case 2 as shown in FIG. 2(A) and FIG. 4 and the swinging arm 44 is pulled on the left-hand side of FIGS. 2(A) and 4 (on the side corresponding to a direction of an arrow Y of FIG. 5) by an expansion force of the expansion/contraction spring 42 of the resilient urging means 40. Thus, the door 3 is held in the position (the first position) where the door 3 closes the opening of the case 1.

Then, as shown in FIGS. 2(B) and 5, when the door 3 is manually opened from the closed position, the parallel link arms 30 and 32 pivotally move about the center of the pivotal pins 30PB and 32PB on the second mount member 22. Under the circumstances, the swinging arm 44 of the resilient urging means 40 pivotally moves the extension 20EB of the first mount member 20 about the center of the pivotal pin 30PA of the link arm 30 while the expansion/contraction spring 42 is contracted whereby the extension 20EB moves toward the second mount member 22 while inclining the door 3 until there reaches a mid-position (neutral position) of door half-closing where the pivotal pin 30PA of the link arm 30 and the pivotal pins 44PA and 44PB of the swinging arm 44 are aligned in a straight line (the position shown in FIG. 2 (B) and FIG. 5). In this position, the expansion force M acts on the expansion/contraction spring 42 whereby the swinging arm 44 is pushed in the direction X, but the swinging arm 44 cannot move by being blocked by the pivotal pin 30PA of the link arm 30. However, as the door 3 even slightly moves in the door opening direction beyond the mid-position, the action force in the direction Z is applied on the swinging arm 44 due to the expansion force M of the expansion/contraction spring 42 and therefore the first mount member 20 swings in the direction indicated by an arrow A (the counterclockwise direction) whereby the link arms 30 and 32 automatically pivotally move due to a principle of parallel link to reach the opened position (the second position) of the door 3 which is the position as shown in FIG. 2(C) and FIG. 6. Thus, after the door 3 moves beyond the half-open mid-position, the door 3 is automatically opened even though it is relieved from the hand.

Figure 6A:
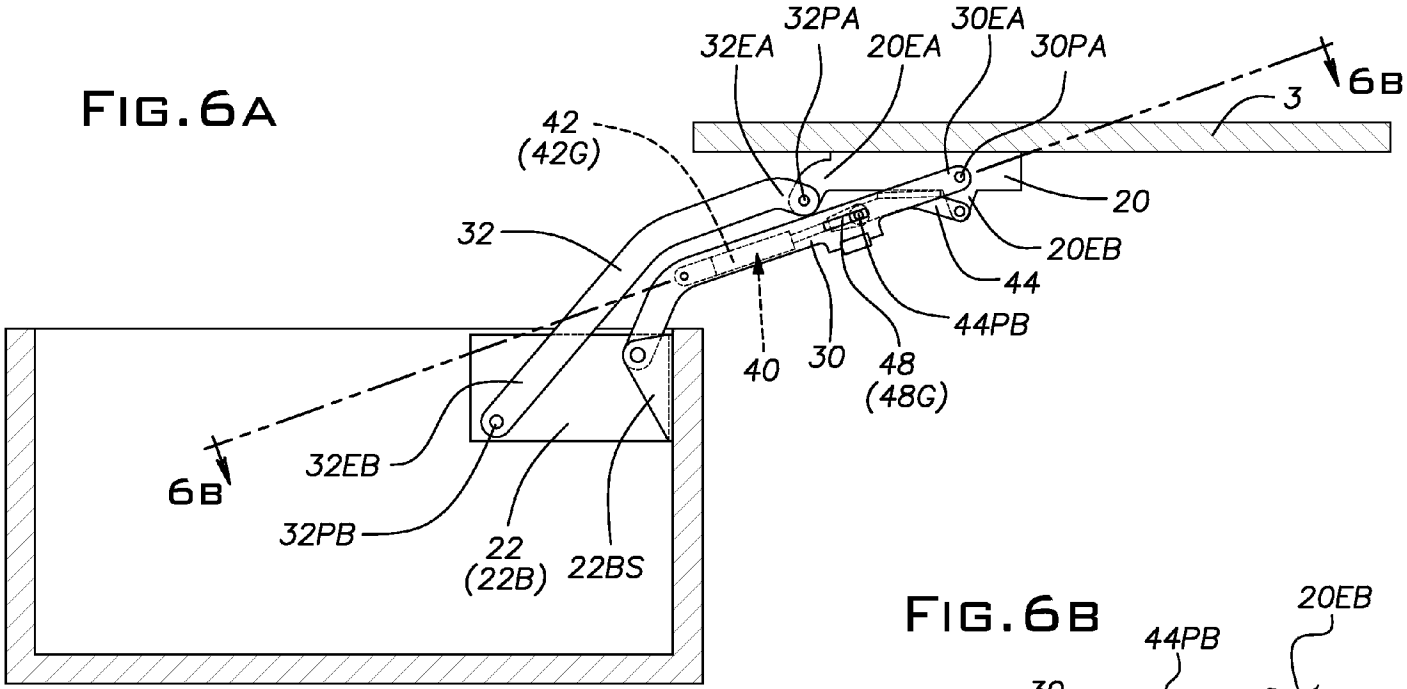
Figure 6B:
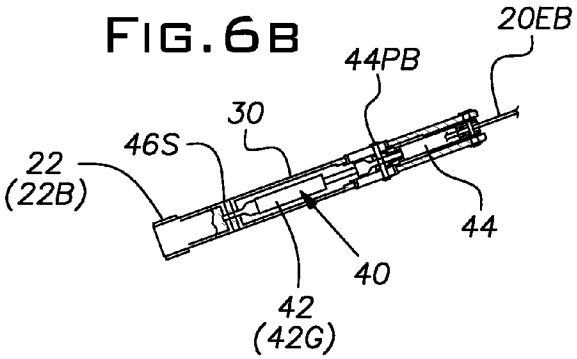

Reversely, when the door 3 is to be closed, the door 3 is manually operated in the door closing direction against the expansion force of the expansion/contraction spring 42 from the position of FIG. 2(C) and FIG. 6 to the position slightly beyond the half-opened mid-position of FIGS. 2(B) 2 and 5. This causes the action force in the direction Y to be applied to the swinging arm 44 due to the expansion force M of the expansion/contraction spring 42 and therefore the first mount member 20 swings in the direction indicated by an arrow B (the clockwise direction) whereby the link arms 30 and 32 are similarly urged due to the principle of parallel link in a door closing direction. Thus, the door 3 is automatically closed even though it is relieved from the hand to be thereby returned to the closed position (the first position) as shown in FIG. 2(A) and FIG. 4.

Although, in the aforementioned form of embodiment, the expansion/contraction spring 42 is disposed within the link arm 30, the link arm 30 may be not in the square cylindrical form, but in the flat form so that the expansion/contraction spring 42 may be disposed between the flat link arm 30 and the movable end 44M of the swinging arm 44.

As aforementioned, since the expansion/contraction spring 42 to urge the link arms 30 and 32 toward either of the door closed position and the door opened position is disposed between the link arm 30 and the swinging arm 44 to move along the linear guide 48 of the link arm 30, the expansion/contraction spring 42 never protrudes from the link arm 30 so much, which causes the expansion/contraction spring to be exposed outside and there never occur the reduction of the appearance and the accident that the finger or fingers are pulled into the movable holder. Furthermore, since the swinging arm 44 moving in accordance with the movement of the expansion/contraction spring 42 moves along the elongated groove 48G of the linear guide 48, the movement of the swinging arm 44 more smoothly in comparison to the prior art in which the swinging arm moves along the arc-like groove and in addition thereto, the guide portion can have the simpler construction and the smaller size. Also, the setting of the attachment position of the first and second mount members 20 and 22 and the attachment operation thereof can be easily made.

Since the pivotal pin 44PB attached to the movable end of the swinging arm 44 makes a straight line movement within the elongated groove 48G of the linear guide 48 when the door 3 is to be opened or closed, the movement of the swinging arm 44 accompanied by the expansion/contraction of the expansion/contraction spring 42 can be smoothly achieved by resistance lower than the arc-like movement within the arc-like groove in the prior art.

In the aforementioned form of embodiment, the expansion/contraction spring 42 is in the form of the gas spring 42G, but may be other than the gas spring. Also, it is in the form of push spring, but it may be in the form of pull spring. In the latter case, the expansion/contraction spring 42 will be positioned in the opposite side relative to the linear guide 48. Furthermore, although, in the illustrated form of embodiment, the expansion/contraction spring 42 is connected to the pivotal pin 44PB of the swinging arm 44, it is not required to be connected to the pivotal pin 44PB, so long as the pivotal pin 44PB can be urged so as to move along the linear guide 48.

Industrial Applicability

In accordance with the invention, since the expansion/contraction spring for urging the link arms to the first or second position is arranged between the link arm and the swinging arm moving along the linear guide, the expansion/contraction spring never protrudes so much from the link arms and therefore the appearance is never prevented from being lowered and the finger or fingers are prevented from being placed into the movable holder. Furthermore, since the swinging arm following the expansion/contraction spring moves along the linear guide, the movement of the swinging arm can be made more smoothly in comparison with the movement of the swinging arm along the arc-like groove. In addition thereto, the guide portion has a simpler structure and a smaller size and the attachment of the movable holder can be more easily made because there are not required such parts as are to be attached while taking care of the attachment position. Thus the invention has the higher industrial applicability.

The invention claimed is:

1. A movable holder including first and second mount members adapted to be attached to a movable member and a stationary member, respectively, and two link arms each having a first end pivotally supported on one of said first and second mount members and a second end pivotally supported on the other of said first and second mount members' said movable holder adapted to hold said movable member on said stationary member so as to be able to move said movable member forward and backward between a first position where said movable member approaches said stationary member and a second position where said movable member is away from said stationary member by pivotal movement of said two link arms relative to said mount members, a spring urging said two link arms to automatically pivotally move toward either one of first and second positions of said link arms corresponding to said first and second positions of said movable member, respectively' when said two link arms are shifted from a neutral position of said link arms disposed between said first and second positions of said link arms toward a respective one of said first and second positions of said link arms, said movable holder characterized by further including a swinging arm having one end of said swinging arm pivotally attached to said first mount member adjacent to a pivotal attachment of one of said first and second ends of one of said link arms to said first mount member and another end of said swinging arm slidable along a linear guide provided in said one of said link arms and said spring being disposed between said one of said link arms and said swinging arm so as to urge said another end of said swinging arm along said linear guide and urge said link arms toward one of said first or second positions of said link arms, and wherein said linear guide comprises an elongated groove provided in said one of said link arms and the another end of said swinging arm has a pivotal pin slidably engaged within said elongated groove, wherein a longitudinal axis of said spring intersects said pivotal attachment of said one of said link arms to said first mount member.

2. A movable holder as set forth in claim 1, wherein a movable end of said spring is connected to said pivotal pin.

* * * * *

UNITED STATES PATENT AND TRADEMARK OFFICE

CERTIFICATE OF CORRECTION

PATENT NO. : 8,904,709 B2
APPLICATION NO. : 12/680768
DATED : December 9, 2014
INVENTOR(S) : Ajiki et al.

It is certified that error appears in the above-identified patent and that said Letters Patent is hereby corrected as shown below:

In the Claims,

In column 7, line 12, being line 6 of claim 1, please delete "members'" and insert therefor
-- members, --

In column 7, line 24, being line 18 of claim 1, please delete "respectively'" and insert therefor
-- respectively, --

Signed and Sealed this
Nineteenth Day of May, 2015

Michelle K. Lee

Michelle K. Lee
*Director of the United States Patent and Trademark Office*